US006860186B2

(12) United States Patent
Cohen

(10) Patent No.: US 6,860,186 B2
(45) Date of Patent: Mar. 1, 2005

(54) CERAMIC BODIES AND BALLISTIC ARMOR INCORPORATING THE SAME

(76) Inventor: Michael Cohen, Kibbutz Kfar Etzion, Mobile Post North Yehuda 90200 (IL)

( * ) Notice: Subject to any disclaimer, the term of this patent is extended or adjusted under 35 U.S.C. 154(b) by 57 days.

(21) Appl. No.: 10/322,237

(22) Filed: Dec. 18, 2002

(65) Prior Publication Data

US 2004/0083880 A1 May 6, 2004

Related U.S. Application Data

(63) Continuation-in-part of application No. 10/256,112, filed on Sep. 26, 2002, now abandoned.

(30) Foreign Application Priority Data

Sep. 19, 2002 (IL) ..... 151830

(51) Int. Cl.[7] ..... F41H 5/02
(52) U.S. Cl. ..... 89/36.02
(58) Field of Search ..... 89/36.02

(56) References Cited

U.S. PATENT DOCUMENTS 3,523,057 A * 8/1970 Buck ..... 428/156
3,705,558 A * 12/1972 McDougal et al. ..... 109/84
4,179,979 A * 12/1979 Cook et al. ..... 89/36.02
4,665,794 A * 5/1987 Gerber et al. ..... 89/36.02
H1061 H * 6/1992 Rozner et al. ..... 89/36.02
H1519 H * 3/1996 Semple ..... 89/36.02
H1567 H * 8/1996 Parsons et al. ..... 89/36.02
5,738,925 A * 4/1998 Chaput ..... 428/101
5,972,819 A * 10/1999 Cohen ..... 501/127
6,112,635 A * 9/2000 Cohen ..... 89/36.02
6,200,664 B1 * 3/2001 Figge et al. ..... 428/178
6,203,908 B1 * 3/2001 Cohen ..... 428/397
6,289,781 B1 * 9/2001 Cohen ..... 89/36.02
6,408,734 B1 * 6/2002 Cohen ..... 89/36.02
6,532,857 B1 * 3/2003 Shih et al. ..... 89/36.02

FOREIGN PATENT DOCUMENTS

DE 2601562 A1 * 1/1977 ..... F41H/5/02
GB 2272272 A * 5/1994 ..... F41H/5/04

* cited by examiner

*Primary Examiner*—Michael J. Carone
*Assistant Examiner*—Troy Chambers
(74) *Attorney, Agent, or Firm*—Fulbright & Jaworski LLP

(57) ABSTRACT

The invention provides a ceramic body for deployment in a composite armor panel, for absorbing and dissipating kinetic energy from high velocity projectiles, the body having a peg-like configuration consisting of a stem section and a head section wherein a cross-sectional area across the stem is less than a cross-sectional area across the head section.

17 Claims, 4 Drawing Sheets

Fig. 1
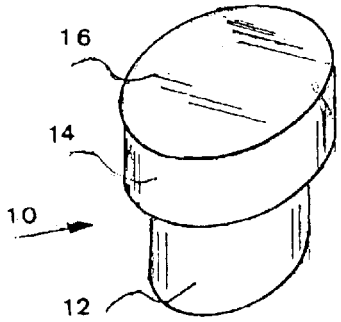
Fig. 2
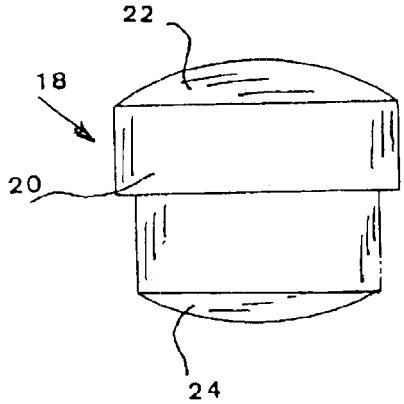
Fig. 3
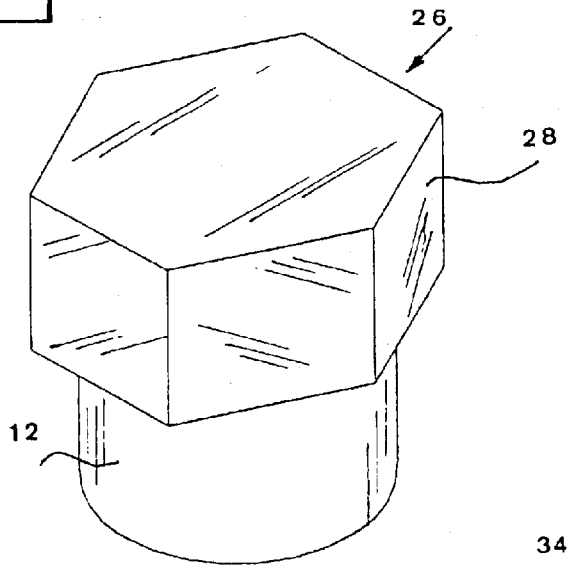
Fig. 4
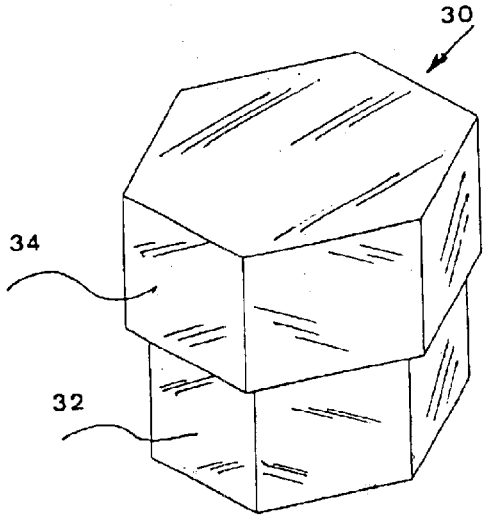
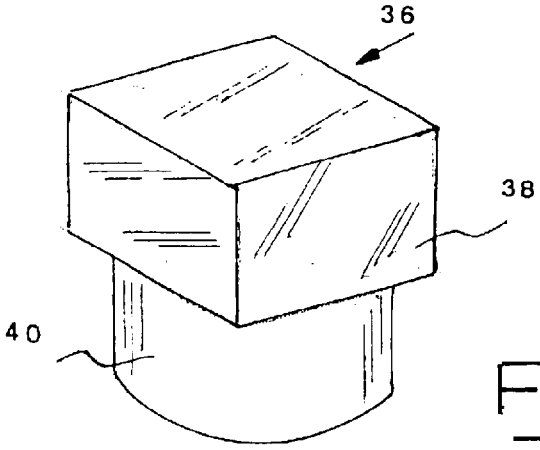
Fig. 5

CERAMIC BODIES AND BALLISTIC ARMOR INCORPORATING THE SAME

The present specification is a continuation in part of U.S. Ser. No. 10/256,112 filed Sep. 26, 2002 now abandoned.

The present invention is a modification of the inventions described in European patent application 96308166.6 (EP-A-0843149), European patent application 98301769.0, and International patent application PCT/GB97/02743 (WO-A-98/15796), WO 99/60327 and W099/53260.

The present invention relates to a ceramic body for deployment in a composite armor panel, for absorbing and dissipating kinetic energy from projectiles and for ballistic armor panels incorporating the same. More particularly, the invention relates to improved ceramic bodies for use in structural armored plates for providing ballistic protection for light and heavy mobile equipment and for vehicles against high-velocity projectiles or fragments.

In EP-A-0843149 there is described a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of superposed rows, characterized in that the pellets have an $Al_2O_3$ content of at least 85%, preferably at least 93%, and a specific gravity of at least 2.5, the majority of the pellets each have at least one axis in the range of about 3–12 mm, and are bound by said solidified material in a single internal layer of superposed rows, wherein a majority of each of said pellets is in direct contact with at least 4 adjacent pellets, the total weight of said plate does not exceed 45 kg/m$^2$ and said solidified material and said plate are elastic.

In European patent application 98301769.0 there is described and claimed a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of adjacent rows, characterized in that the pellets have an $Al_2O_3$ content of at least 93% and a specific gravity of at least 2.5, the majority of the pellets each have at least one axis of at least 12 mm length and are bound by said solidified material in a single internal layer of adjacent rows, wherein a majority of each of said pellets is in direct contact with at least 4 adjacent pellets, and said solidified material and said plate are elastic.

In WO-A-9815796 there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In WO 99/60327 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

In WO 99/53260 there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

The teachings of all five of these specifications are incorporated herein by reference.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described. According to the present invention there is now provided a ceramic body for deployment in a composite armor panel, for absorbing and dissipating kinetic energy from high velocity projectiles, said body having a peg-like configuration consisting of a stem section and a head section wherein a cross-sectional area across said stem is less than a cross-sectional area across said head section.

In preferred embodiments of the present invention, said stem section has a regular geometric cross-section and especially preferred is a stem section with a circular cross-section or a regular polygonal cross-section such as a hexagonal cross-section.

In further preferred embodiments of the present invention, said head section also has a regular geometric cross-section and especially preferred is a stem section with a circular, cross-section or a regular polygonal cross-section such as a hexagonal cross-section.

While the head and stem sections can have the same, but differently sized, cross-section, this is not necessarily the case and, e.g., a body with a stem of circular cross-section and a head of hexagonal cross-section can also be molded for use in the present invention.

In a further aspect of the present invention, there is provided a ballistic armor panel for absorbing and dissipating kinetic energy from high velocity projectiles, said panel comprising:

a plurality of ceramic bodies, each of said bodies having a peg-like configuration consisting of a stem section and a head section wherein a cross-sectional area across said stem is less than a cross-sectional area across said head section; and a substrate for assembling said bodies in a close-packed, single layer array, such that each of a majority of said bodies is positioned with its head section in direct contact with the head section of at least four and preferably six adjacent bodies and the stems of said bodies are supported and held by said substrate.

In especially preferred embodiments of the present invention there is provided a ballistic armor panel for absorbing and dissipating kinetic energy from high velocity projectiles, said panel comprising: a plurality of ceramic bodies, each of said bodies having a peg-like configuration consisting of a stem section and a head section wherein a cross-sectional area across said stem is less than a cross-sectional area across said head section; and a plate member having a plurality of openings, each of said opening sized to receive a stem section of a body with the underside of the head section of said body overriding the periphery of said opening, such that each of a majority of said bodies is positioned with its head section in direct contact with the head section of at least four and preferably six adjacent bodies inserted in said plate.

The armor plates described in EP-A-0843149 and European patent application 98301769.0 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using pellets made of sintered refractory materials or ceramic materials having a specific gravity below that of aluminum oxide, e.g., boron carbide with a specific gravity of 2.45, silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdenum, titanium and silica can be used and especially preferred for use in said publication and also in the present invention the ceramic bodies utilized herein are formed of a ceramic material selected from the group consisting of sintered oxide, nitrides, carbides and borides of alumina, magnesium, zirconium, tungsten, molybdenum, titanium and silica.

More particularly, the present invention relates to a ceramic body as defined for absorbing and dissipating kinetic energy from high velocity armor piercing projectiles, wherein said body is made of a material selected from the group consisting of alumina, boron carbide, boron nitride, titanium diboride, silicon carbide, silicon oxide, silicon nitride, magnesium oxide, silicon aluminum oxynitride and mixtures thereof.

In U.S. Ser. No. 09/924,745 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments described therein each of said channels occupies a volume of up to 25% within its respective pellet.

Said channels can be bored into preformed pellets or the pellets themselves can be pressed with said channel already incorporated therein.

The teaching of said specification are also incorporated herein by reference.

Thus, in preferred embodiments of the present invention a channel is provided in said body to reduce the weight per area thereof and preferably said channel occupies a volume of up to 25% of said body.

In accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

As will be realized, since material is removed from the pellets of the present invention their weight is decreased, as is the overall weight of the entire composite armor plate from which they are formed, thereby providing the unexpected improvement of reduced weight of protective armor panels without loss of stopping power, as shown in the examples hereinafter.

In preferred embodiments of the present invention said pellets each have a major axis and said pellets are arranged with their major axes substantially parallel to each other and oriented substantially perpendicularly relative to said outer impact-receiving major surface of said panel.

In a most preferred embodiment of the present invention a ballistic armor panel as defined herein is provided for incorporation in an opening provided in an armored vehicle.

Thus the present invention also provides an armored vehicle having ballistic armor panels according to the present invention incorporated therein.

In further embodiments of the present invention the ceramic bodies of the present invention are constructed of transparent ceramic material.

In especially preferred embodiments of the present invention the plate member utilized in the ballistic armor panel is formed from a plurality of interconnected rings which optionally are further bound together by a solidified material.

The solidified material can be any suitable material, such as aluminum, a thermoplastic polymer such as polycarbonate, or a thermoset plastic such as epoxy.

In French Patent 2,711,782, there is described a steel panel reinforced with ceramic materials; however said panel does not have the ability to deflect armor-piercing projectiles unless a thickness of about 8–9 mm of steel is used, which adds undesirable excessive weight to the panel and further backing is also necessary thereby further increasing the weight thereof.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising an elastic material for absorbing the remaining kinetic energy from said fragments. Said elastic material will be chosen according to cost and weight considerations and can be made of any suitable material, such as aluminum or woven or non-woven textile material.

In especially preferred embodiments of the multi-layered armor panel, the inner layer adjacent to said outer layer comprises a tough woven textile material for causing an asymmetric deformation of the remaining fragments of said projectile and for absorbing the remaining kinetic energy from said fragments, said multi-layered panel being capable of stopping three projectiles fired sequentially at a triangular area of said multi-layered panel, wherein the height of said triangle is substantially equal to three times the length of the axis of said pellets.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention, in which the head of each of the bodies is in direct contact with six adjacent bodies.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

In U.S. Pat. Nos. 3,523,057 and 5,134,725 there are described further armored panels incorporating ceramic and glass balls; however, said panels are flexible and it has been found that the flexibility of said panels substantially reduces their stopping strength upon impact, since the force of impact itself causes a flexing of said panels and a reduction of the supporting effect of adjacent constituent bodies on the impacted constituent body, due to the arrangement thereof in said patent. Thus, it will be noted that the teachings of U.S. Pat. No. 5,134,725 is limited to an armor plate having a plurality of constituent bodies of glass or ceramic material which are arranged in at least two superimposed layers, which arrangement is similar to that seen in U.S. Pat. No. 3,705,558. In addition, reference to FIGS. 3 and 4 of said patent show that pellets of a first layer do not contact pellets of the same layer and are only in contact with pellets of an adjacent layer and therefore do not benefit from the support of adjacent pellets in the same layer to provide mutual lateral confinement of the pellets, as taught in the present invention.

As will be realized in the preferred embodies of the present invention there is provided a structural, load-bearing ballistic armor wherein the plate member having a plurality of openings provides the structural framework while the peg-like configuration of the ceramic bodies of the present invention assure that the bodies are still in direct contact with each other via their head sections thereby providing mutual lateral confinement and reinforcement not available in armor wherein the pellets are separated by a rigid honeycomb array.

Thus, it has been found that the novel armor of the present invention traps incoming projectiles between several pellets which are held with their head sections in a single layer in rigid mutual abutting and laterally-confining relationship.

An incoming projectile may contact the pellet array in one of three ways:

1. Center contact. The impact allows the full volume of the pellet to participate in stopping the projectile, which cannot penetrate without pulverizing the whole pellet, an energy-intensive task. The pellets used are preferably of circular or hexagonal cross-section or other regular geometric shapes having at least one convexly-curved end face, said end face being oriented to substantially face in the direction of an outer impact receiving major surface of said plate.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the substrate or plate, and penetration is prevented.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

FIG. 1 is a perspective view of a preferred embodiment of the ceramic body according to the invention;

FIG. 2 is an elevational view of a similar ceramic body provided with convex ends;

FIG. 3 is a perspective view of an embodiment provided with a hexagonal head;

FIG. 4 is a perspective view of an embodiment provided with a prismatic stem section;

FIG. 5 is a perspective view of a ceramic body having a square head;

Figure 6A:
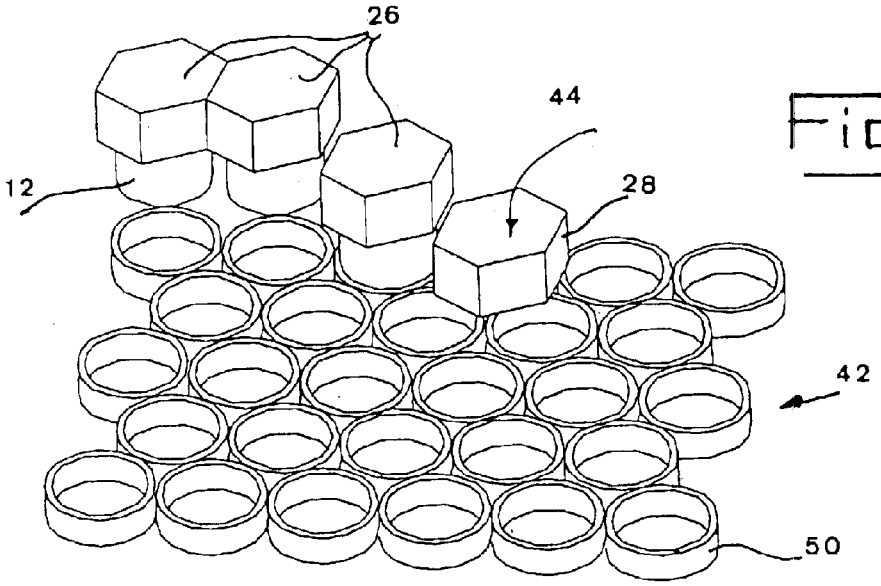
Figure 6B:
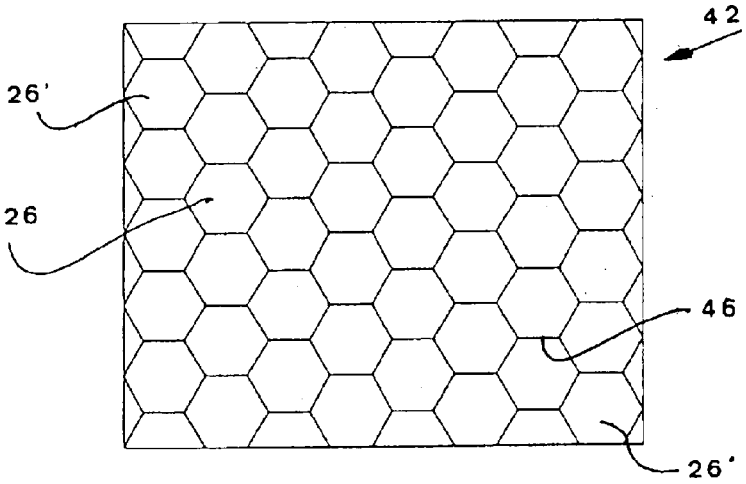

FIG. 6*a* is a perspective view of a ballistic armor panel constructed using the ceramic body seen in FIG. 3;

FIG. 6*b* is an elevational view of the panel seen in FIG. 6*a;*

Figure 7:
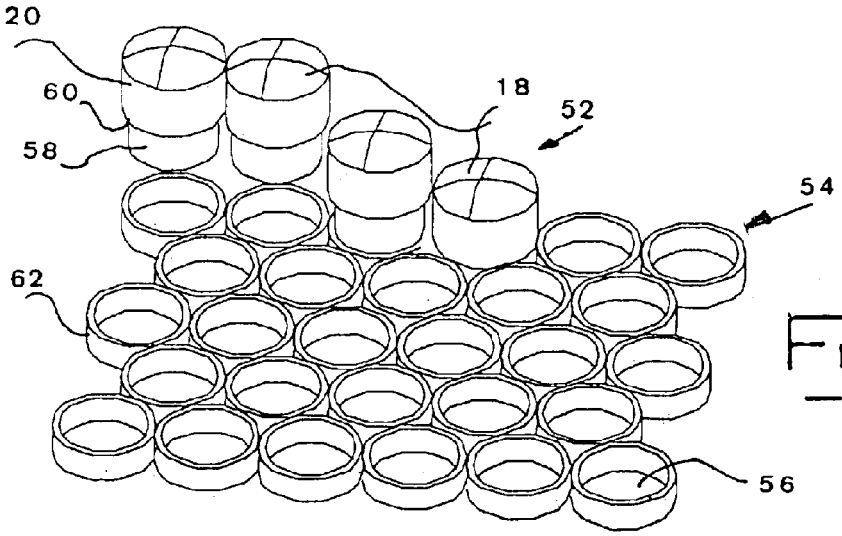
Figure 8:
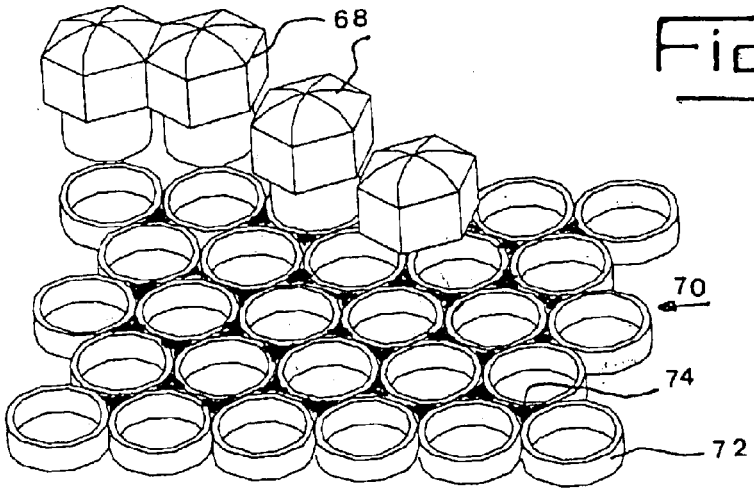
Figure 9:
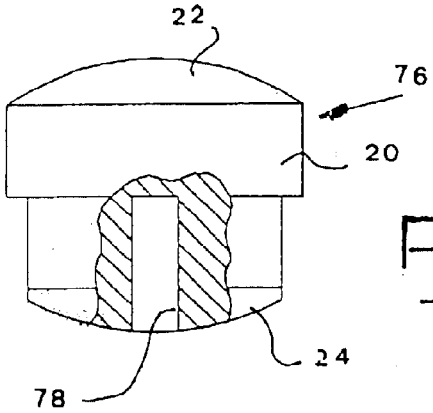
Figure 10:
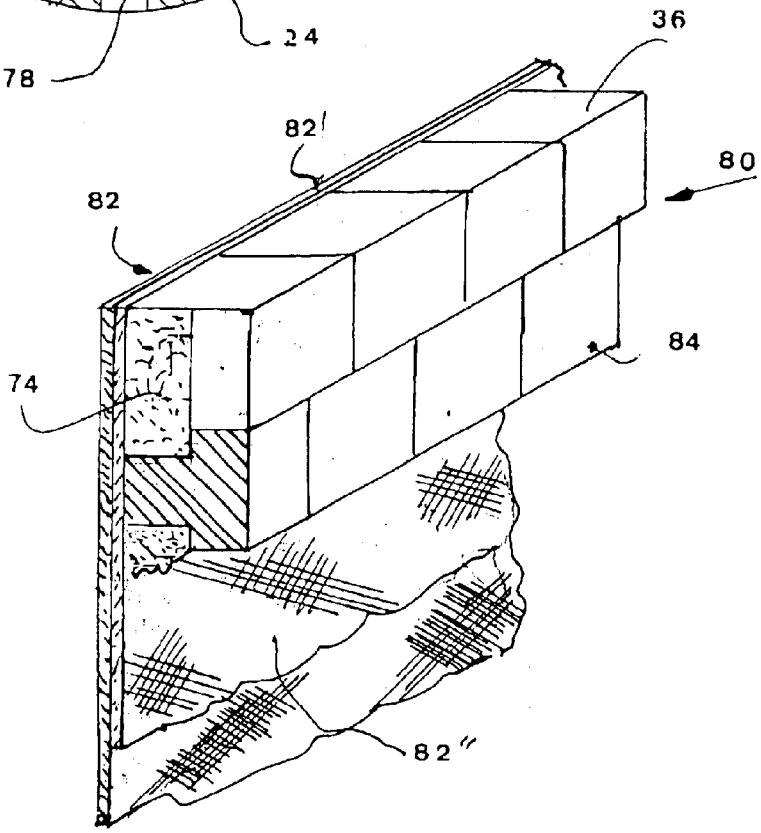
Figure 11A:
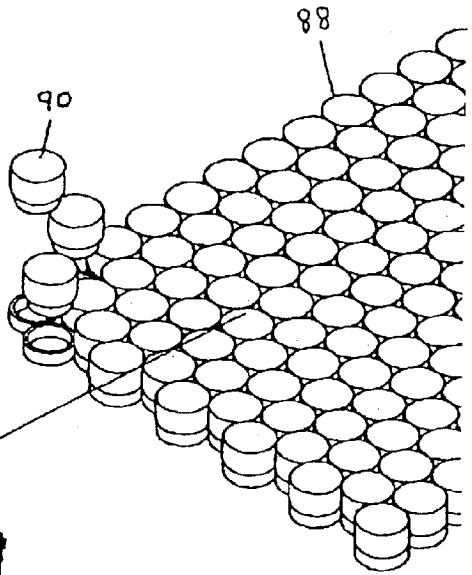
Figure 11:
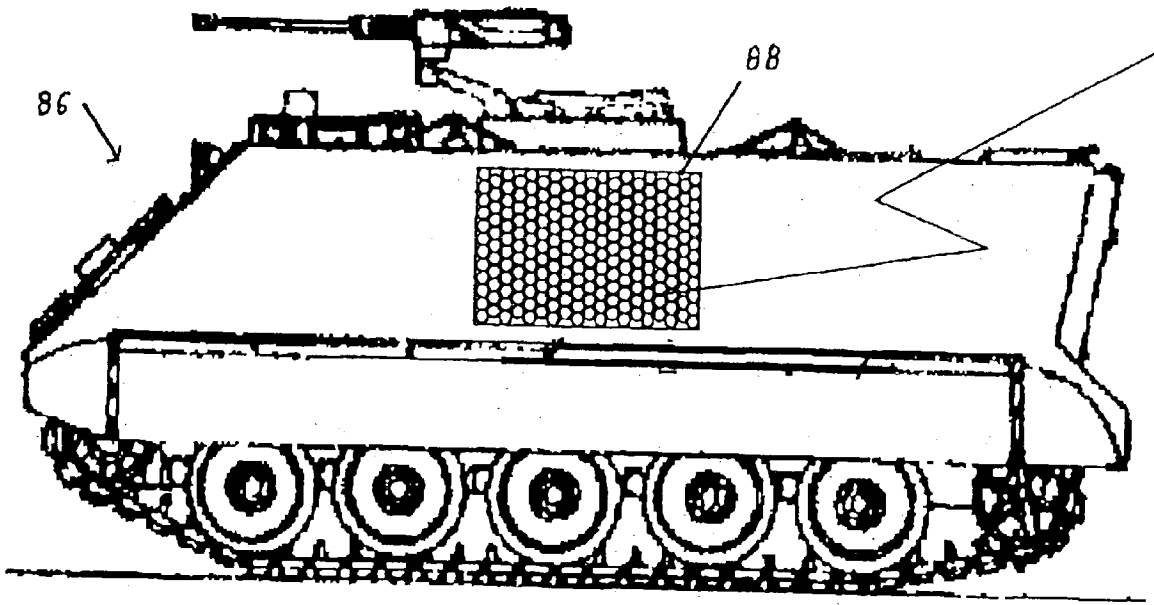

FIG. 7 is a perspective view of a panel built using the ceramic body seen in FIG. 2;

FIG. 8 is a perspective view of an armor panel built using a ceramic body similar to that shown in FIG. 3, the head section end being convex;

FIG. 9 is a partially-sectioned elevational view of a ceramic body having a weight-deducing slot;

FIG. 10 is a fragmented perspective view of a further embodiment of a ballistic armor panel; and FIGS. 11 and 11*a* are schematic illustrations of an armored vehicle incorporating a panel of the present invention.

There is seen in FIG. 1 a ceramic body 10 intended for deployment in a composite armor panel. Examples of several such panels will be shown starting with FIG. 6*a*. The panel is designed for absorbing and dissipating kinetic energy from high velocity projectiles, such as rifle fire and small shell fragments.

The body 10 has a peg-like configuration consisting of a stem section 12 and a head section 14. As can be seen, a cross-sectional area across the stem section 12 is less than a cross-sectional area across the head section 14.

In the preferred embodiment seen in the figure, the stem section 12 has a regular geometric cross-section, which in this case is circular. In the present embodiment the head section also has a circular cross-section, and a flat top face 16.

The body 10 is formed of a ceramic material. Preferred ceramics are sintered oxide, nitrides, carbides and borides of alumina, magnesium, zirconium, tungsten, molybdenum, titanium and silica.

Where the pellet is intended to be used for absorbing and dissipating kinetic energy from armor piercing projectiles, other materials are preferred. These materials are typically alumina, boron carbide, boron nitride, titanium diboride, silicon carbide, silicon oxide, silicon nitride, magnesium oxide, silicon aluminum oxynitride and mixtures thereof.

FIG. 2 illustrates a ceramic body 18 wherein the head section 20 is provided with a convex head face 22 and a convex end face 24. The convex head shape 22 encourages sideways deflection of bullets impacting the pellet head. Thus the projectile is stopped as explained above regarding "Flank Contact".

The convex end face 24 facilitates assembly of the body 18 into an armor panel, which will be seen in FIG. 7.

Referring now to FIG. 3, there is depicted a ceramic body 26 wherein the head section 28 has a regular geometric cross-section; in the present embodiment the head section is hexagonal.

The armor panel resulting from use of this arrangement will be described with reference to FIG. 6*b*.

FIG. 4 illustrates a further embodiment of a ceramic body 30 wherein also the stem section 32 has a regular polygonal cross-section. Such configuration is useful in applications where it is advantageous to prevent the rotation of the body if the head section 34 is impacted by a high-velocity fragment.

Seen in FIG. 5 is a ceramic body 36 wherein the head section 38 has a regular polygonal cross-section, in the present embodiment this being square. As in previous embodiments the body has a peg-like configuration consisting of a stem section 40 and a head section 38. The cross-sectional area across the stem section 40 is less than the cross-sectional area across the head section 38.

Referring now to FIGS. 6*a* and 6*b*, there is depicted a ballistic armor panel 42 for absorbing and dissipating kinetic energy from high velocity projectiles. The outer face 44 of the panel 42 comprises a large number of ceramic bodies 26, as described with reference to FIG. 3.

The ceramic bodies 26 are inserted and held in a close-packed, single layer array 46. Excepting the ceramic bodies 26' around the outer borders of the panel, each body 26 is positioned with its head section 28 in direct contact with the head section 28 of six adjacent bodies 26. Thus the ceramic bodies provide mutual lateral confinement and reinforcement, which is important for retaining stopping power after a first projectile has impacted the panel 42 resulting in some damage to the ceramic body 26 which was hit.

The stems 12 of the bodies 26 are supported and held by the substrate 50.

FIG. 7 shows a further ballistic armor panel 52 for absorbing and dissipating kinetic energy from high velocity projectiles.

A plurality of ceramic bodies 18 are seen, as described with reference to FIG. 2.

The bodies 18 are retained in a plate member 54 having many openings 56, each opening being sized to receive the stem section 58 of one of the ceramic bodies. The underside 60 of the head section 20 of the body 18 overrides the periphery of the opening 56.

Except for the outer edges 62 of the armor panel 52, each body is positioned with its head section 20 in direct contact with six adjacent bodies 18 inserted in the plate member 54.

Turning now to FIG. 8, there is seen a ballistic armor panel faced with ceramic bodies 68. The body 68 is similar to the body 26 seen in FIG. 3, except that the head of the body 68 is convex.

The plate member 70 is formed from a plurality of interconnected rings 72. The rings 72 can be mass produced using dedicated tooling therefor. Advantageously the rings 72 are further bound together by a solidified material 74, for example aluminum, or a thermoplastic polymer such as polycarbonate, or a thermoset plastic such as epoxy.

FIG. 9 shows a further embodiment of a ceramic body 76. The body 76 is similar to the body 18 seen in FIG. 2. An important feature of body 76 is a channel 78 provided in the body to reduce the weight per area thereof. Suitably, the channel 78 occupies a volume of up to 25% of the body 76.

The body 76 is particularly useful for airborne use and for personal applications.

Referring now to FIG. 10, there is seen a further embodiment of a ballistic armor panel 80. The panel 80 has an inner 82 and an outer 84 surface, the outer surface 84 facing the impact side. Ceramic bodies 36 are arranged in a plurality of adjacent rows. The axes of the stems sections 40 of the bodies 36 are substantially parallel with each other and perpendicular to the surfaces of the panels 82, 84.

Preferably the inner layer 82 is formed from a plurality of adjacent layers 82', 82", each layer comprising a plurality of unidirectional coplanar anti-ballistic fibers embedded in a polymeric matrix. Advantageously, the fibers of adjacent layers 82', 82", are oriented at an angle of between about 45° to 90° to each other.

In operation the outer, impact-receiving layer deforms and shatters an impacting high velocity projectile. The inner layer, being elastic, is then able to absorb the remaining kinetic energy from the projectile fragments. The elastic material is chosen according to cost and weight considerations applicable to the designated application. Although any suitable material can be used, such as aluminum or woven or non-woven textile material, the preference is for at least 90% Aramide fiber, fiber orientation being as described. The final material selection is based on meeting weight and volume restraints at lowest cost.

Referring now to FIGS. 11 and 11*a* there is seen an armored vehicle 86 wherein a panel 88 of the present invention has been provided in an opening (not shown) of said vehicle, the panel 88, in the embodiment shown, incorporating ceramic bodies 90 having cylindrical heads and cylindrical stems, said panel being shown in an enlarged detail view in FIG. 11*a*.

As will be realized since the panels of the present invention are lighter in weight then steel panels of comparable size and provide even better protection it is advantageous to incorporate several panels according to the present invention in such vehicles in place of standard steel armor in order to reduce the overall weight of the vehicle.

As is known transparent ceramic material is available as described e.g., in H1567 and H1519 and such material could be used in the panels of the present invention.

In order to establish the effectiveness of the ceramic bodies of the present invention and composite armor panels incorporating the same a panel was prepared with the size of 10×12 in and ceramic bodies having a cylindrical stem and hexagonal head section with a convexly curved end face as illustrated in FIG. 8 was prepared and sent to the H. P. White Laboratory, Inc. in Md. for ballistic resistance testing.

The description of the test and the results are set forth hereinafter.

TEST PANEL

| | | | | | |
|---|---|---|---|---|---|
| Manufacturer: | MOFET ETZION | Sample No.: | LI8A A | Date Rec'd: | Sep. 4, 2005 |
| Size: | 10 × 12 in. | Weight: | 7.20 lbs. | Via: | HAND CARRIED |
| Thicknesses: | 0.919, 0.920, 0.913, 0.909 in. | Hardness: | NA | Returned: | FedEx |
| Avg. Thick.: | 0.915 in. | Plies/Laminates: | NA | | |
| Description: | PROPRIETARY | | | | |

SET-UP

| | | | | | |
|---|---|---|---|---|---|
| Shot Spacing: | PER CUSTOMER REQUEST | Primary Val. Screens: | 15.0 ft., 35.0 ft. | Range No.: | 3 |
| Witness Panel: | 0.020", 2024-T3 ALUMINUM | Primary Val. Location: | 25.0 ft. From Muzzle | Temp.: | 73 F. |
| Obliquity: | 0 deg. | Residual Val. Screens: | NA | BP: | 30.17 in. Hg |

-continued

| | | | | | |
|---|---|---|---|---|---|
| Booking Material: | NA | Residual Val. Location: | NA | RH: | 62% |
| Conditioning: | AMBIENT | Range to Target: | 45.0 ft. | Barrel No./Gun: | TEST BARREL |
| | | Target to Wit.: | 8.0 in. | Gunner: | FULK |
| | | | | Recorder: | POOLE |

AMMUNITION

| | | | |
|---|---|---|---|
| (1): | 7.62 mm AP, M61, 150 gr. | Lot No.: | 01FNB88 |
| (2): | | Lot No.: | |
| (3): | | Lot No.: | |
| (4): | | Lot No.: | |

APPLICABLE STANDARDS OR PROCEDURES

| | |
|---|---|
| (1): | PER CUSTOMER REQUEST |
| (2): | |
| (3): | |

| Shot No. | Ammo. | Time 1 (used) | Velocity 1 (ft/s) | Time 2 (used) | Velocity 2 (ft/s) | Avg. Vel. (ft/s) | Vel. Loss (ft/s) | Strike Vel. (ft/s) | Penetration | Footnotes |
|---|---|---|---|---|---|---|---|---|---|---|
| 1 | 1 | 7087 | 2822 | 7091 | 2820 | 2821 | 16 | 2806 | None | |
| 2 | 1 | 7115 | 2811 | 7118 | 2810 | 2810 | 16 | 2795 | None | |
| 3 | 1 | 7092 | 2820 | 7093 | 2820 | 2820 | 16 | 2804 | None | |
| 4 | 1 | 7131 | 2805 | 7137 | 2802 | 2803 | 16 | 2788 | None | |
| 5 | 1 | 7079 | 2825 | 7082 | 2824 | 2825 | 16 | 2809 | None | |
| 6 | 1 | 7095 | 2819 | 7098 | 2818 | 2818 | 16 | 2803 | None | |

As will be noted said panel having a weight of only 7.2 pounds provided exceptional multi-impact performance wherein none of the 7.62×51 mm, 150 grain, armor piercing, M61 projectiles fired at a distance of 45 feet from the target penetrated said panel.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A ballistic armor panel for absorbing and dissipating kinetic energy from high velocity projectiles, said panel comprising:

a) a plurality of ceramic bodies, each of said bodies having a peg-like configuration consisting of a stem section and a head section having an underside wherein any cross-sectional area across said stem is less than a cross-sectional area across said head section; and (b) a plate member having a plurality of openings, each of said openings being sized to receive a stem section of said body with the underside of the head section of said body overriding the periphery of said opening, such that each of a majority of said bodies is positioned with its head section in direct contact with the head section of six adjacent bodies inserted in said plate.

2. A ballistic armor panel according to claim 1 wherein said plate member is formed from a plurality of interconnected rings.

3. A ballistic armor panel according to claim 2 wherein said rings are further bound together by a solidified material.

4. A ballistic armor panel according to claim 1, wherein said panel has an inner and an outer surface, said outer surface facing the impact side and said ceramic bodies are arranged in a plurality of adjacent rows, the axis of the stems of said bodies being substantially parallel with each other and perpendicular to the surfaces of the panels.

5. A ballistic armor according to claim 2, further comprising an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

6. A ballistic armor panel according to claim 1 whenever incorporated in an armored vehicle.

7. A ballistic armor panel according to claim 1, wherein said stem section of each of said ceramic bodies has a regular geometric cross-section.

8. A ballistic armor panel according to claim 7, wherein said stem section of each of said ceramic bodies has a regular polygonal cross-section.

9. A ballistic armor and according claim 7, wherein said stem section of each of said ceramic bodies has a circular cross-section.

10. A ballistic armor panel according to claim 1, wherein said head section of each of said ceramic bodies has a regular geometric cross-section.

11. A ballistic armor panel according to claim 10, wherein said head section of each of said ceramic bodies has a regular polygonal cross-section.

12. A ballistic armor panel according to claim 10, wherein said head section of each of said ceramic bodies has a circular cross-section.

13. A ballistic armor panel according to claim 1, wherein each said ceramic body is formed of a ceramic material selected from the group consisting of sintered oxide, nitrides, carbides and borides of alumina, magnesium, zirconium, tungsten, molybdenum, titanium and silica.

14. A ballistic armor panel as claimed in claim 1 for absorbing and dissipating kinetic energy from high velocity armor piercing projectiles, wherein each said ceramic body is made of a material selected from the group consisting of alumina, boron, carbide, boron nitride, titanium diboride, silicon carbide, silicon oxide, silicon nitride, magnesium oxide, silicon aluminum oxynitride and mixtures thereof.

15. A ballistic armor panel according to claim 1, wherein said head section of each said ceramic bodies is provided with a convexly curved end face.

16. A ballistic armor panel according to claim 1, characterized in that a channel is provided in each of said ceramic bodies to reduce the weight per area thereof.

17. A ballistic armor panel according to claim 16, wherein said channel occupies a volume of up to 25% of each of said ceramic bodies.

* * * * *